US008336987B2

(12) United States Patent
Ito et al.

(10) Patent No.: US 8,336,987 B2
(45) Date of Patent: Dec. 25, 2012

(54) IMAGE FORMING APPARATUS

(75) Inventors: Yoichi Ito, Tokyo (JP); Akiyoshi Tanaka, Fujisawa (JP); Tsuguyori Kemma, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 359 days.

(21) Appl. No.: 12/700,447

(22) Filed: Feb. 4, 2010

(65) Prior Publication Data

US 2010/0207990 A1 Aug. 19, 2010

(30) Foreign Application Priority Data

Feb. 14, 2009 (JP) ..... 2009-032076

(51) Int. Cl.
*B41J 29/13* (2006.01)

(52) U.S. Cl. ..... 347/27

(58) Field of Classification Search ..... 347/27
See application file for complete search history.

(56) References Cited

U.S. PATENT DOCUMENTS

| | | | | |
|---|---|---|---|---|
| 5,281,978 | A * | 1/1994 | Kojima et al. | 347/257 |
| 7,434,927 | B2 | 10/2008 | Sakuma et al. | |
| 7,591,551 | B2 | 9/2009 | Imoto et al. | |
| 2006/0164491 | A1 | 7/2006 | Sakuma et al. | |
| 2009/0058911 | A1 | 3/2009 | Kogure et al. | |

FOREIGN PATENT DOCUMENTS

| | | |
|---|---|---|
| JP | 3-256772 | 11/1991 |
| JP | 2001-138499 | 5/2001 |
| JP | 2003-237165 | 8/2003 |
| JP | 2005-81673 | 3/2005 |
| JP | 2005-212160 | 8/2005 |
| JP | 2007-152900 | 6/2007 |

OTHER PUBLICATIONS

U.S. Appl. No. 12/555,898, filed Sep. 9, 2009. (claims and drawings).

* cited by examiner

*Primary Examiner* — Jerry Rahll
(74) *Attorney, Agent, or Firm* — Cooper & Dunham LLP

(57) ABSTRACT

An image forming apparatus includes a housing, a carriage, and a damping mechanism. The carriage includes an image forming mechanism and moves back and forth in a main scan direction. The damping mechanism generates an impact to suppress vibration caused by movement of the carriage. The damping mechanism suppresses vibration during at least one of acceleration and deceleration of the carriage, and is inactive during movement of the carriage at a constant speed. The damping mechanism suppresses vibration when acceleration of the carriage equals or exceeds a predetermined threshold acceleration. The damping mechanism includes a suppression member and a mass member that strikes the suppression member. The suppression member is at least one of a shock absorber and an elastic member. Shock absorbing characteristics of the shock absorber and elasticity of the elastic member are variable.

10 Claims, 11 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2009-032076, filed on Feb. 14, 2009 in the Japan Patent Office, which is hereby incorporated herein by reference in its entirety.

BACKGROUND OF THE INVENTION

1. Field of the Invention

Exemplary aspects of the present invention generally relate to an image forming apparatus, and more particularly, to an image forming apparatus including a recording head mounted on a carriage that reciprocally travels back and forth.

2. Description of the Background Art

There is known an image forming apparatus, such as a printer, a facsimile machine, a copier, and a multi-functional system having a plurality of these functions thereof, which employs an ink jet recording device for ejecting ink onto a recording medium such as a sheet of paper to form an image thereon.

Such an ink jet recording device uses, for example, a recording head that ejects liquid droplets of ink.

In the image forming apparatus of this type, an image forming operation is conducted by the recording head that ejects ink droplets onto a recording medium, typically although not necessarily a sheet of paper. It is to be noted that the image forming operation mentioned herein refers to any operation by which an image is fixed in tangible form, whether by recording, printing, imaging, or some other process or combination of processes.

Such an image forming apparatus is generally classified into two types, a serial-type image forming apparatus and a line-type image forming apparatus. The serial-type image forming apparatus performs the image forming operation by moving the recording head in a main scan direction while ejecting ink droplets onto a sheet of a recording medium. By contrast, the line-type image forming apparatus uses a line-type recording head that performs the image forming operation by ejecting the ink droplets without moving the recording head, that is, by keeping the recording head stationary while moving the sheet of the recording medium.

In such a serial-type image forming apparatus, a carriage on which the recording head is mounted moves reciprocally back and forth, inducing vibration in the image forming apparatus. In particular, in order to increase printing speed, the speed of movement of the carriage is increased, causing rapid acceleration and deceleration of the carriage when the carriage moves in the main scan direction. As a result, significant vibration occurs in the image forming apparatus when the speed of the carriage is rapidly increased or decreased. In a case in which the multi-functional image forming apparatus equipped with an image reading device such as a scanner, such vibration adversely affects scanning by the scanner, thereby causing degradation of a read image.

To counteract such a difficulty, various techniques have been proposed to reduce vibration of the carriage. For example, a damping member, also known as a counter weight, having substantially the same weight as that of the carriage, is attached to a timing belt that drives the carriage. The damping member is moved in the opposite direction of the carriage, thereby suppressing vibration of the carriage.

In another example of a vibration suppressing technique, a set of drive mechanisms, different from a drive mechanism that drives a printing head, is provided to move the damping member having the same weight as the printing head in a direction opposite the printing head at a constant speed.

However, although effective, there is a drawback to the above-described approaches. That is, because the damping member is attached to the timing belt that moves the carriage and always moves as the carriage moves so as to suppress vibration, fluctuation in any of the speed of the carriage, a moving load of the carriage, and the weight of the carriage as the ink is consumed from an ink tank on the carriage causes the damping member to vibrate undesirably. In particular, the damping member vibrates more than enough to suppress the vibration of the carriage. As a result, ink droplets are prevented from being accurately ejected onto a target position, thereby degrading imaging quality.

Furthermore, there is a drawback in this configuration in that the load against a drive source for moving the carriage increases. Since the damping member having the same mass as that of the carriage is used, the weight of the image forming apparatus as a whole increases, thereby complicating efforts to make the image forming apparatus compact.

SUMMARY OF THE INVENTION

In view of the foregoing, in one illustrative embodiment of the present invention, an image forming apparatus includes a housing, a carriage, and a damping mechanism. The carriage includes an image forming mechanism and moves back and forth in a main scan direction. The damping mechanism generates an impact to suppress vibration caused by movement of the carriage.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
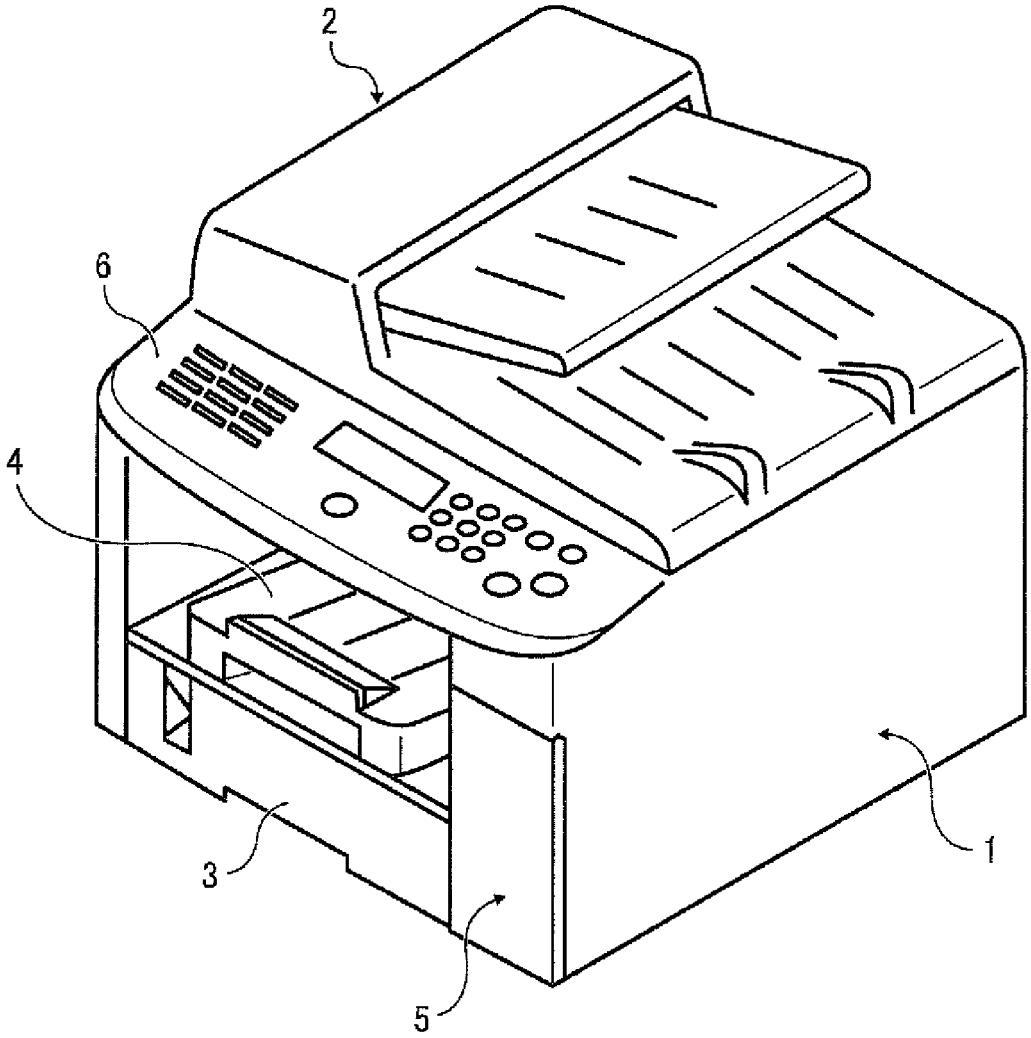
FIG. 1 is an external perspective schematic view of an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

It is to be noted that the image forming apparatus of the ink jet recording method herein refers of to an apparatus that performs image forming operation by applying ink to a medium including, but not limited to, paper, a thread, fiber, a cloth, leather, metal, plastic, glass, wood, ceramic, and the like.

Image formation also includes, in addition to recording, printing and imaging, forming an image including letters, symbols, and patterns on the above-described recording medium. The image forming operation herein also simply refers to applying ink droplets onto the medium.

It is to be noted that the ink is not limited to what is called "ink". The word "ink" is herein used as a collective term that refers to a DNA reagent, and a registration and patterning material that are ejected in a form of liquid.

The sheet-type recording medium includes, but is not limited to, paper, an OHP sheet, and a cloth, onto which the ink is applied.

Referring now to the drawings, an image forming apparatus according to an illustrative embodiment is described.

Figure 2:
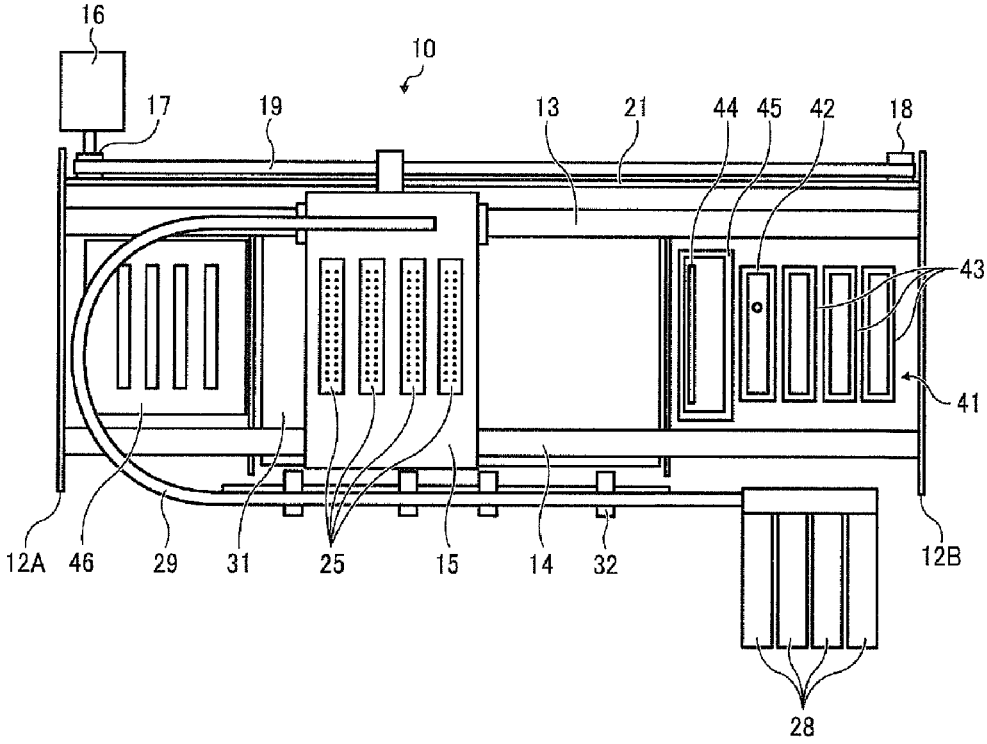
FIG. 2 is a plan schematic view of a mechanical section of the image forming apparatus of FIG. 1.
Figure 3:
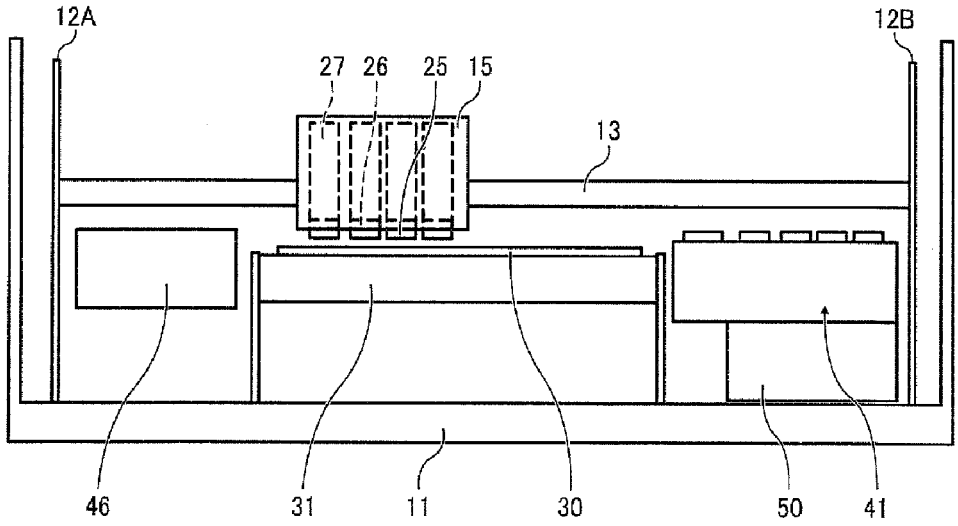
FIG. 3 is a front schematic view of the mechanical section of FIG. 2.

With reference to FIGS. 1 through 4, a description will be provided of an example of an image forming apparatus to which the present invention is applied. FIG. 1 is a perspective schematic view of an image forming apparatus 1. FIG. 2 is a plan schematic view of a mechanical section 10 of the image forming apparatus 1. FIG. 3 is a front schematic view of the mechanical section 10.

As illustrated in FIG. 1, an image reader (scanner) 2 to read an image is disposed at the top of the image forming apparatus. A sheet feed cassette 3 that stores and supplies recording media sheets is detachably mountable relative to the image forming apparatus 1. The sheet feed cassettes 3 stores the recording media sheets to be fed to the mechanical section 10. A sheet discharge tray 4 is disposed substantially above the sheet feed cassette 3 and receives the recording medium that is discharged after an image is formed thereon.

The image forming apparatus 1 includes a cartridge mounting portion 5 at a front side (a proximal side) of the image forming apparatus 1. An ink cartridge is mounted on the cartridge mounting portion 5. In addition, an operation/display portion (operation panel) 6 is disposed at the front side. A user enters operational instructions (signals) through the operation/display portion 6 that displays various information.

As illustrated in FIGS. 1 through 4, the mechanical section 10 of the image forming apparatus 1 includes side plates 12A and 12B, a guide rod 13 serving as a main guide member, sub guide rod 14 serving as a sub guide member, a carriage 15, and so forth. The side plates 12A and 12B are disposed on a housing 11 of the image forming apparatus. The guide rod 13 is laid between the side plate 12A and 12B. The carriage 15 is slidably supported in a main scan direction (a longitudinal direction of the guide rod) by the guide rod 13 and the sub guide rod 14.

The mechanical section 10 includes also a main scan motor 16, a drive pulley 17, a driven pulley 18, and a timing belt 19. The main scan motor 16, the drive pulley 17, the driven pulley 18, and the timing belt 19 constitute a main scan mechanism that moves the carriage 15 in the main scan direction.

Figure 4:
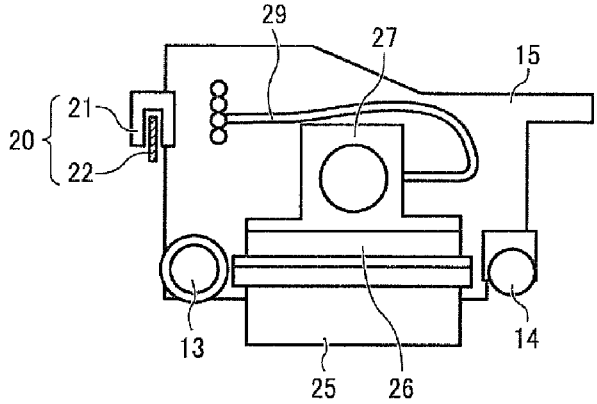
FIG. 4 is a side schematic view of the mechanical section of FIG. 2.

An encoder scale 21 (shown in FIG. 4) is disposed along the main scan direction of the carriage 15. As illustrated in FIG. 4, an encoder sensor 22 including a transmissive photosensor is disposed on the back of the carriage 15 so as to read a scale of the encoder scale 21 serving as a position indicator. The encoder scale 21 and the encoder sensor 22 constitute a linear encoder 20 serving as a carriage position detector.

As illustrated in FIG. 3, the carriage 15 includes four recording heads 25 serving as an image forming mechanism, a filter 26, and a sub ink tank 27. The recording heads 25 include ejection heads, each of which ejects ink droplets of respective colors black (K), cyan (C), magenta (M), and yellow (Y). The sub ink tank 27 supplies ink to the recording heads 25 through the filter 26.

Each of the recording heads 25 includes a nozzle array arranged in a sub-scan direction perpendicular to the main scan direction. The nozzle array includes a plurality of nozzles. The recording heads 25 are mounted to the carriage 15 such that the ink is ejected downward.

A main tank 28, also known as an ink cartridge, is detachably mountable relative to the cartridge mounting portion 5 and stores each color of ink. The main tank 28 supplies the ink to the sub-tank 27 through an ink tube 29.

Substantially below the carriage 15, a transfer belt 31 serving as a transport member is disposed to transport a recording medium supplied from the sheet feed cassette 3 in the sub-scan direction. The transport belt 31 is an endless belt and stretched between a transport roller and a tension roller, not illustrated. As the transport roller is rotated by a sub-scan motor, not illustrated, the transport belt 31 is rotated in the sub-scan direction. Substantially below the transport belt 31, a sheet discharge roller 32 is disposed. The sheet discharge roller 32 discharges the recording medium on which an image is formed.

As illustrated in FIG. 2, a recovery mechanism 41 that maintains and recovers the condition of the recording head 25 is disposed in a non-image forming region at one side of the main scan direction of the carriage 15. The recovery mechanism 41 includes a suction cap 42, a moisturizing cap 43, a wiper blade 44, a waste ink receiver 45, and so forth. The suction cap 42 suctions ink from the recording head 25 and moisturizes the nozzle surface. The moisturizing cap 43 also moisturizes the nozzle surface. The wiper blade 44 wipes the nozzle surface. The waste ink receiver 45 catches liquid droplets ejected during empty ejection in which ink that is not used during image formation is ejected.

The waste ink is then discharged to a waste ink tank 50 in FIG. 3 disposed substantially at the bottom of the main tank 28 in the cartridge mounting portion 5 of the image forming apparatus 1. As illustrated in FIG. 3, the waste ink tank 50 is detachably mountable at the bottom of the main tank 28.

A waste ink receiver 46 is disposed at the non-image forming region at the other side in the main scan direction of the carriage 15 to catch ink droplets ejected during empty ejection in which ink that is not used during image formation is ejected.

In the image forming apparatus 1, the recording medium is transported from the sheet feed cassette 3 by a sheet feed mechanism, not illustrated, onto the transport belt 31. Subsequently, the transport belt 31 intermittently transports the recording medium while the carriage 15 is moved in the main scan direction.

The recording head 25 is driven in accordance with an image signal while the carriage 15 is moved in the main scan direction, thereby ejecting ink droplets onto the recording medium that is not moving and recording an image for one line. As the recording medium is transported by a predetermined amount, the recording operation for recording subsequent lines is repeated until an image is formed on the recording medium. After the image is formed on the recording medium, the recording medium is discharged.

Figure 5:
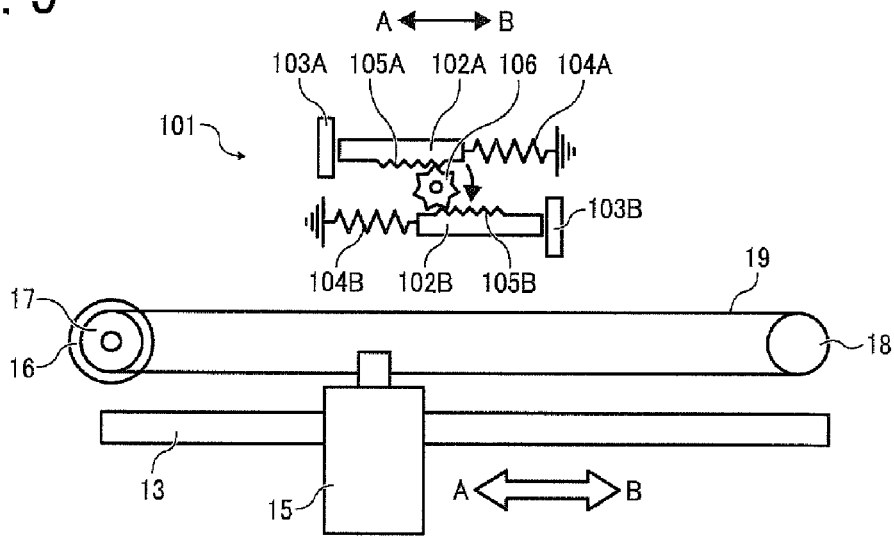
FIG. 5 is a plan schematic view of a damping mechanism according to a first illustrative embodiment of the present invention.

Referring now to FIGS. 5 and 6, a description will be provided of a first illustrative embodiment of the present invention. FIG. 5 and FIG. 6 are plan schematic views illustrating a damping mechanism according to the illustrative embodiment.

As described above, the carriage 15 is reciprocally moved in the main scan direction (arrow A and arrow B directions) through the main scan mechanism including the main scan motor 16, the drive pulley 17, the driven pulley 18, and the timing belt 19.

As illustrated in FIG. 5, a damping mechanism 101 is disposed on the housing 11 of the image forming apparatus 1. It is to be noted that the location of the damping mechanism 101 is not limited to the housing 11 as will be later described. The damping mechanism 101 can be disposed substantially above the carriage 15, for example.

The damping mechanism 101 serving as a vibration suppression mechanism suppresses vibration of the image forming apparatus 1 caused by the movement of the carriage 15. The damping mechanism 101 includes a counter weight 102A, a counter weight 102B, shock absorbers 103A and 103B, urging members 104A and 104B, gear portions 105A and 105B, and a drive member 106. It is to be noted that letter symbols A and B are hereinafter omitted when no discrimination therebetween is necessary.

The counter weight 102 is a mass body serving as a damping member and movably disposed in the directions indicated by arrows A and B in FIG. 5. The shock absorber 103 serves as a suppression member that contacts the counter weight 102. The shock absorber 103 includes, for example, a spring, an oil damper, or the like.

The urging member 104 is a spring or the like that urges the counter weight 102 toward the shock absorber 103. The drive member 106 meshes with the gear portion 105 and rotates in the direction indicated by an arrow, thereby moving the counter weight 102 against the urging force of the urging member 104. In other words, the drive member 106 enables the urging member 104 to store its urging force.

The shock absorber 103 absorbs impact when the counter weight 102 strikes the shock absorber 103 so that an inertial force of the carriage 15 coincides with the impact of the counter weight 102. The shock absorber 103 also suppresses noise when the counter weight 102 strikes the shock absorber 103.

The shock absorber 103 does not have to be entirely formed of material that absorbs impact. The shock absorber 103 may include a rigid portion inside thereof. The shock absorber 103 is fixed on the housing 11.

The drive member 106 is rotated by a drive mechanism, not illustrated, in the direction indicated by arrow in FIG. 5. The drive member 106 and the counter weight 102 are disengaged at a predetermined timing (damping timing).

The drive member 106 is not driven by the main scan motor 16 that drives the carriage. Thus, stress on the main scan motor 16 is reduced. The drive mechanism that rotates the drive member 106 may also serve as a drive source for the sheet feed mechanism, the sheet transport mechanism, and the recovery mechanism 41.

Figure 6A:
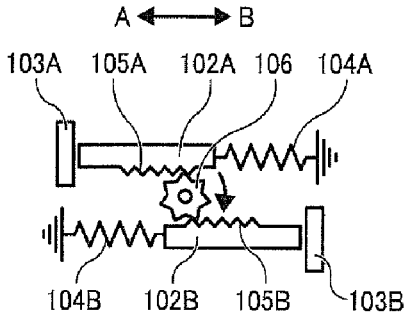
FIGS. 6A and 6B are enlarged schematic views of the damping mechanism of FIG. 5.
Figure 6B:
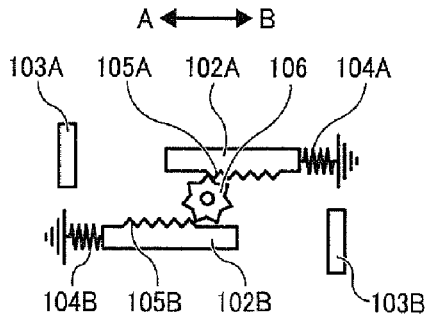

In the damping mechanism 101 as described above, when the carriage 15 is moved in the direction indicated by arrow B, for example, the drive member 106 is rotated in the direction of arrow shown in FIG. 6A causing the counter weight 102A to move in the direction of arrow B, thereby enabling the urging member 104A to store its urging energy as illustrated in FIG. 6B.

When the drive member 106 and the counter weight 102A are disengaged at the predetermined timing (damping timing), the urging member 104A is released, thereby causing the counter weight 102A to move in the direction of arrow A, striking the shock absorber 103A. The shock absorber 103A absorbs the impact of the counter weight 102A such that the inertial force of the carriage 15 and the impact of the counter weight 102A coincide, thereby cancelling out the inertial force of the carriage 15 by the impact of the counter weight 102A. As a result, vibration caused by the movement of the carriage 15 is suppressed.

When, for example, the carriage 15 is moved in the direction of arrow A, the counter weight B is used and the same operation as described above is performed.

Figure 7:
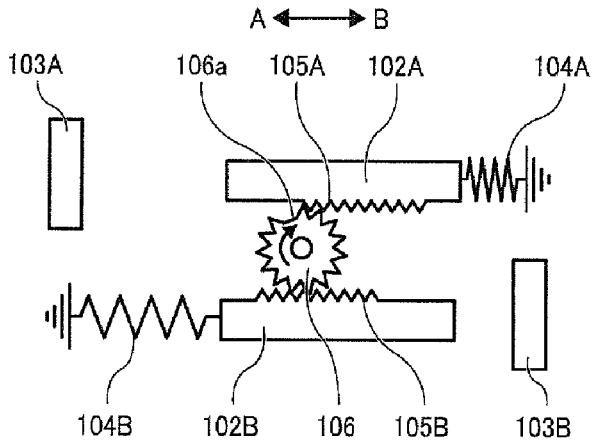
FIG. 7 is an enlarged schematic view of a positional energy release mechanism according to the first illustrative embodiment of the present invention.

With reference to FIG. 7, one example of a disengaging structure of the drive member 106 and the counter weight 102 is described below. According to the illustrative embodiment, a portion of the drive member 106 includes a disengaging portion 106*a* that does not have a gear tooth. At the disengaging portion 106*a*, the drive member 106 and the counter weight 102 are disengaged.

With this configuration, when the drive member 106 is rotated at least the predetermined amount in the direction of arrow in FIG. 7, the gear portion 105A of the counter weight 102A is disengaged from the drive member 106, thereby releasing the urging energy of the urging member 104A. As a result, the counter weight 102A moves in the direction of arrow A.

When the drive member 106 is moved further in the direction of arrow, the drive member 106 meshes with the counter weight 102A so that both the urging members 104A and 104B store urging energy. As the drive member 106 is rotated further, the drive member 106 and the gear portion 105B of the counter weight 102B are disengaged, releasing the urging member 104B, thereby causing the counter weight 102B to move in the direction of arrow B.

Generally, when the carriage moves back and forth, vibration of the carriage occurs. In particular, vibration occurs in alternate directions opposite the traveling direction of the carriage. However, with the configuration shown in FIG. 7, vibration in alternate directions can be suppressed simply by rotating the drive member 106 unidirectionally. Furthermore, when the drive member 106 is synchronized with the movement of the carriage 15, good damping can be performed with such a simple configuration.

It is to be noted that the shock absorber 103 (suppression member) formed of a shock absorbing member is used as an object to be struck by the counter weight 102 which is a mass body. Alternatively, an elastic member such as rubber and sponge may be used as the suppression member instead of the shock absorber. In such a case, the same effect can be achieved.

Figure 8:
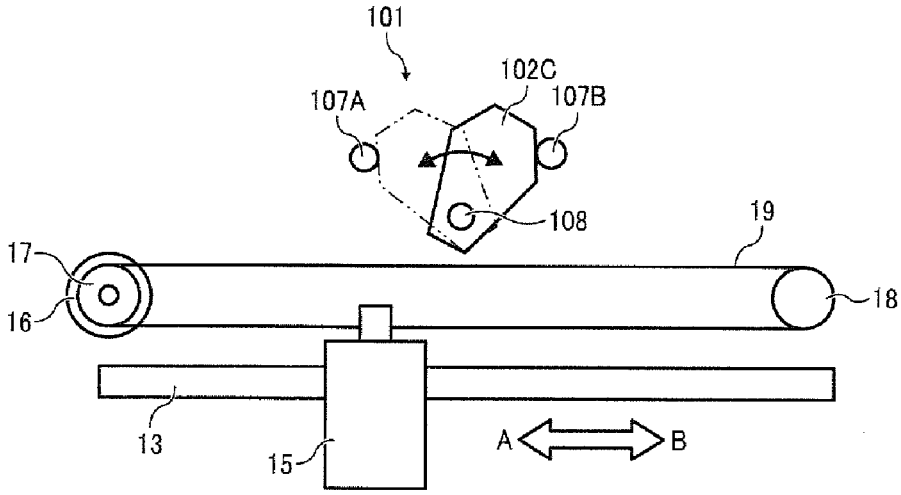
FIG. 8 is a plan schematic view of a damping mechanism according to a second illustrative embodiment of the present invention.

Referring now to FIG. 8, a description will be provided of a second illustrative embodiment of the present invention. FIG. 8 is a schematic diagram illustrating the damping mechanism 101 according to the second embodiment of the present invention.

According to the present embodiment, a counter weight 102C is disposed swingably about a spindle 108. The counter weight 102C is swung or rotated by a drive mechanism, not illustrated. Suppression members 107A and 107B, each formed of a rigid body, are disposed such that there is a certain space therebetween in the main scan direction so that the counter weight 102C can swingably move between the suppression members 107A and 107B. The suppression members 107A and 107B are fixed to the housing 11, for example.

In the damping mechanism 101 of the present embodiment, the counter weight 102C is moved in the direction of arrow at a predetermined timing (damping timing), striking the suppression member 107. Accordingly, the impact of the counter weight 102C striking the suppression member 107 cancels out the inertial force of the carriage 15. Accordingly, vibration is suppressed when the carriage 15 moves.

According to the foregoing embodiments described above, when the damping mechanism generates impact to suppress vibration caused by the movement of the carriage, undesirable vibration can be suppressed efficiently with a simple configuration.

In other words, by using the impact as described above, the drive source does not need to control complicated devices such as a stepping motor, a DC motor, an encoder, and so forth to move the counter weight (mass body) in the main scan direction. The vibration of the carriage can be suppressed by the impact generated when positional energy of a solenoid and the spring enables the counter weight to move and strike the suppression member.

Now, a description is provided of a difference between the suppression member formed of the shock absorber as in the first embodiment and the suppression member formed of the rigid body as in the second embodiment.

Figure 9:
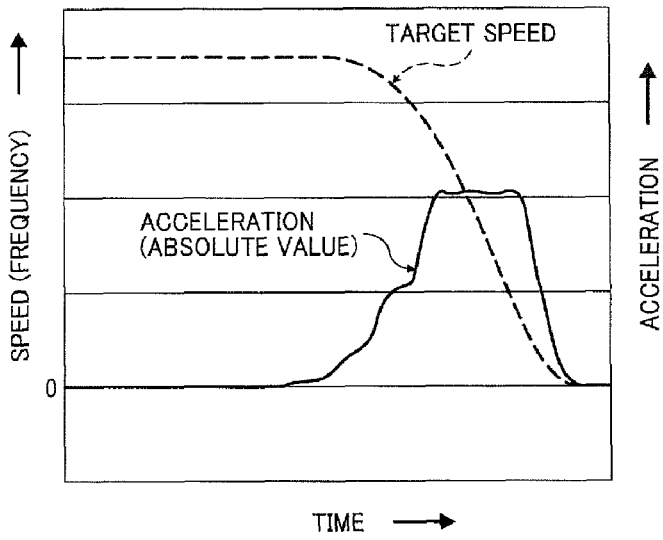
FIG. 9 is a graph showing a change in an acceleration of a carriage when the carriage is stationary according to an illustrative embodiment of the present invention.

As shown in FIG. 9, when the carriage is stationary, acceleration relative to a target speed changes moderately to some extent at certain intervals. The force applied to the image forming apparatus by the carriage is proportional to the acceleration of the carriage. In order to cancel out the inertial force of the carriage more precisely using the impact as the counter weight strikes the suppression member, the sum of the inertial force of the counter weight and the inertial force of the carriage needs to be zero. In order to do so, an absolute value of the acceleration of the counter weight when the speed of the counter weight slows down needs to be proportional to the acceleration of the carriage.

Figure 10:
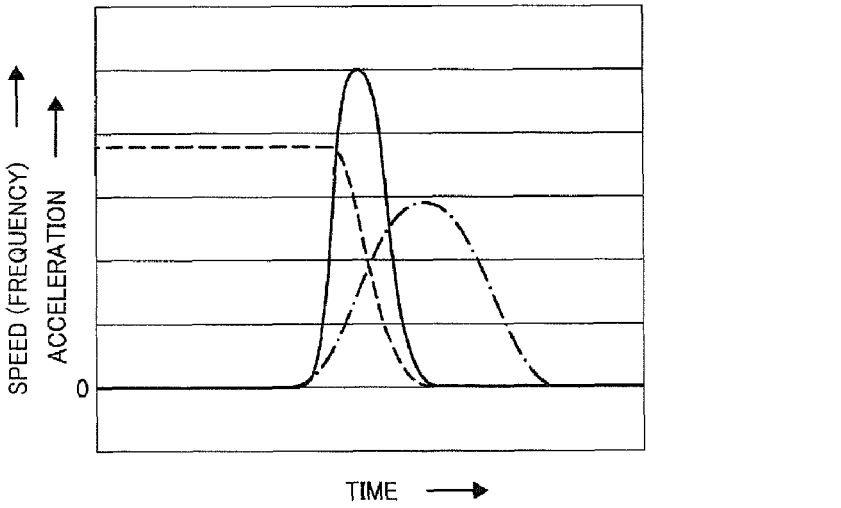
FIG. 10 is a graph showing a change in an acceleration of the carriage when a shock is generated by a counter weight.

When the rigid body is used as the suppression member as in the second illustrative embodiment, the change in the acceleration (absolute value) of the counter weight as the counter weight slows down is abrupt as shown by a solid line in FIG. 10. The waveform of the acceleration of the counter weight as the counter weight slows down is different from the waveform of the acceleration of the carriage when the carriage slows down. As a result, vibration due to the movement of the carriage may not be suppressed with precision.

By contrast, when the shock absorber or an elastic member is used as the suppression member as in the first illustrative embodiment, change in the acceleration (absolute value) of the counter weight when the counter weight slows down is moderate as shown by a long dashed dotted line in FIG. 10. Accordingly, the similar, if not the same waveform as that of the change in the acceleration of the carriage as shown by the solid line in FIG. 9 can be obtained.

In view of the above, it is more preferable to use the shock absorber or the elastic member as the suppression member than the rigid body in a case in which the impact generated when the mass body (counter weight) strikes the suppression member is used to suppress the vibration due to movement of the carriage.

According to the first illustrative embodiment, an actuator that can be turned on and off is driven in conjunction with the carriage. However, the positional energy to generate the impact, for example, compression of the spring (accumulation of force), does not need to be operated in conjunction with the movement of the carriage. The power can be stored at any time or at any speed before acceleration of the carriage. This configuration allows greater flexibility in the drive source, thereby increasing commonality of the drive source and thus reducing the cost.

Referring now to FIG. 11, there is provided a schematic diagram illustrating a third illustrative embodiment of the present invention. According to the present embodiment, pressure members 111 are provided to press the shock absorber 103.

Figure 11A:
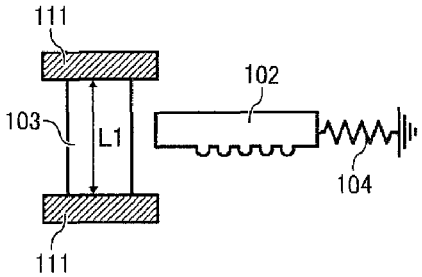
FIGS. 11A and 11B are plan schematic views of a damping mechanism according to a third illustrative embodiment of the present invention.
Figure 11B:
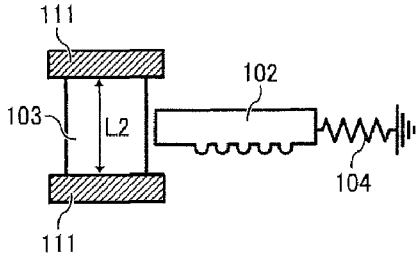

If a distance L1 between the pressure members 111 as illustrated in FIG. 11A is changed to a distance L2 as illustrated in FIG. 11B (L2<L1), shock absorbing characteristics (hereinafter referred to as a characteristic value) of the shock absorber 103 decreases. In other words, it is possible to accommodate changes in the speed of the carriage if the characteristic value of the shock absorber 103 is changed.

In general, the speed profile of a carriage is not just one. The carriage includes various types of speed profiles depending on a print mode of the image forming apparatus.

The carriage 15 according to the illustrative embodiments also includes a plurality of speed profiles. If there are different print modes in which the carriage 15 needs to be driven at different speeds, when the impact of the counter weight is adjusted by the characteristic value of the shock absorber, it is difficult to cancel out the inertial force of the carriage 15 with precision at different print modes.

To address such a difficulty, according to the present embodiment, as illustrated in FIGS. 11A and 11B, the characteristic value (shock absorbing characteristics) of the shock absorber is variable so that different impact can be generated to accommodate different speed profiles of the carriage speed.

Figure 12:
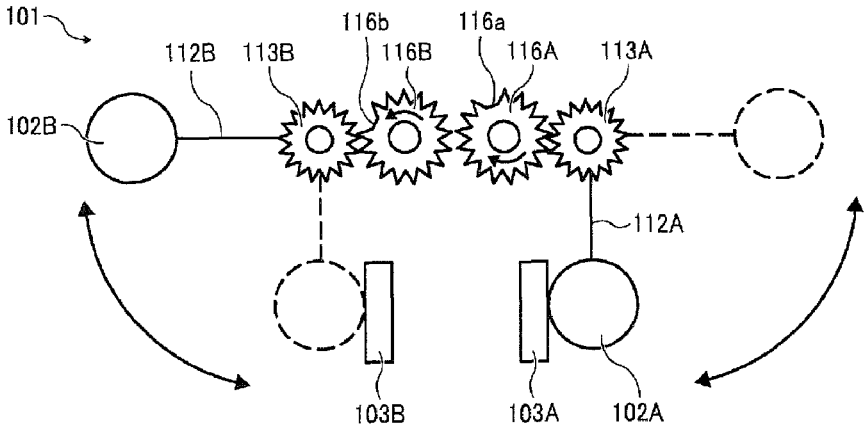
FIG. 12 is a plan schematic view of a damping mechanism according to a fourth illustrative embodiment of the present invention.

Next, with reference to FIG. 12, a description will be provided of a fourth illustrative embodiment of the present invention. FIG. 12 shows a plan schematic view of the damping mechanism 101.

According to the present embodiment, by releasing the positional energy in the direction of the height (gravity) of the counter weights 102A and 102B, the counter weights 102A and 102B strike the shock absorber 103A and 103B to generate impact, thereby suppressing vibration.

In particular, the counter weights 102A and 102B are supported swingably in the direction of gravity by support members 113A and 113B through arms 112A and 112B. Gear teeth are formed at the periphery of the support members 113A and 113B and mesh with gear teeth of drive members 116A and 116B. Similar to the foregoing embodiments, the drive member 116A and 116B include disengaging portions 116*a* and 116*b* which do not include a gear tooth.

When the drive members 116A and 116B rotate more than a predetermined amount, the drive members 116A and 116B and the support member 113A and 113B are disengaged, thereby allowing the counter weights 102A and 102B to fall to swing by the self weight.

As a device to provide the positional energy to the counter weights 102A and 102B, the common drive source used by other devices can be used as described above. Alternatively, a solenoid can be used.

With this configuration, the similar effect, if not the same effect achieved in the first illustrative embodiment can be achieved. Furthermore, because the self weight of the mass body (the counter weight) is used as an urging member, the configuration can be made simple.

Figure 13:
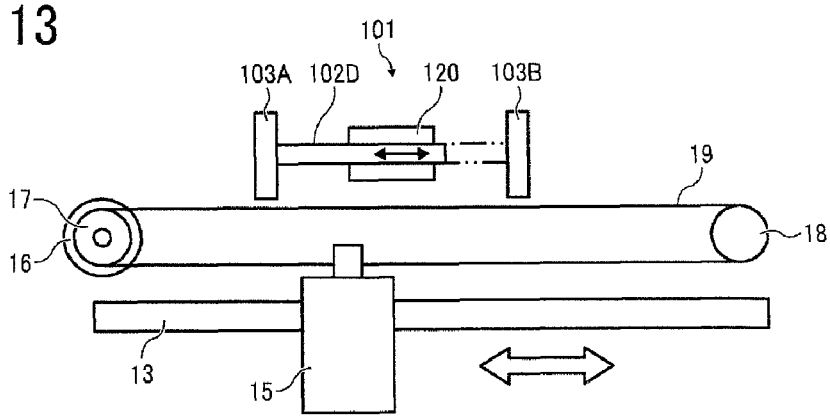
FIG. 13 is a plan schematic view of a damping mechanism according to a fifth illustrative embodiment of the present invention.

Now, with reference to FIG. 13, a description will be provided of a fifth illustrative embodiment of the present invention. FIG. 13 is a schematic diagram illustrating the damping mechanism 101 according to the fifth illustrative embodiment of the present invention.

According to the present embodiment, the damping mechanism 101 includes a solenoid 120 including a plunger 102D. The plunger 102D moves back and forth and is used as the mass body (counter weight) that strikes the shock absorber 103A and 103B, thereby simplifying the structure and thus achieving cost reduction.

Figure 14:
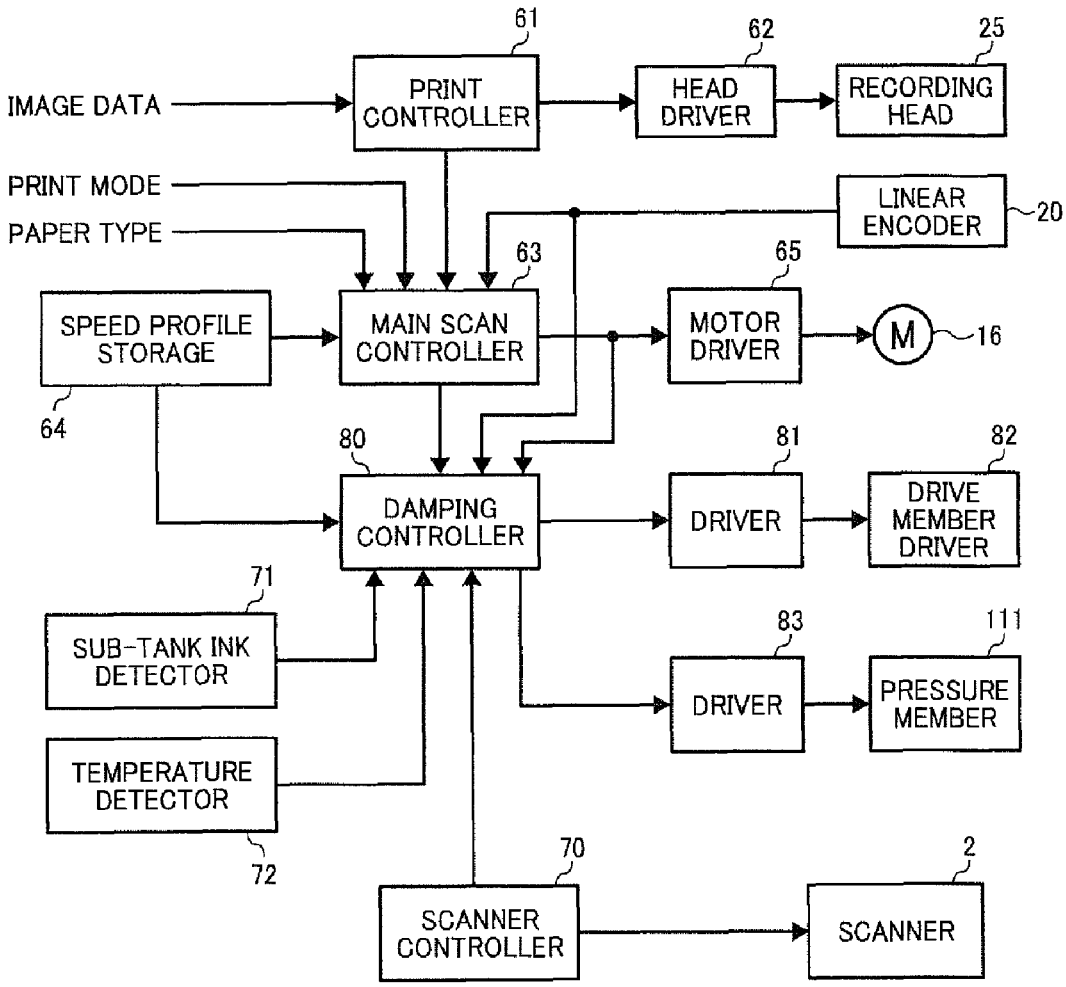
FIG. 14 is a block diagram illustrating a control unit of the damping mechanism according to the third illustrative embodiment of the present invention.

Referring now to FIG. 14, there is provided a block diagram illustrating an example of a control unit of the damping mechanism 101 of the third illustrative embodiment in which the characteristic value of the shock absorber 103 is variable.

In FIG. 14, a print controller 61 receives image data from an external information processor such as a personal computer, not illustrated, the image reader 2, and so forth. In accordance with the image data, the print controller 61 controls the recording head 25 through a head driver 62, thereby enabling the recording head 25 to eject ink onto a recording medium 30 such as a sheet of paper. Accordingly, an image is formed thereon.

Figure 15:
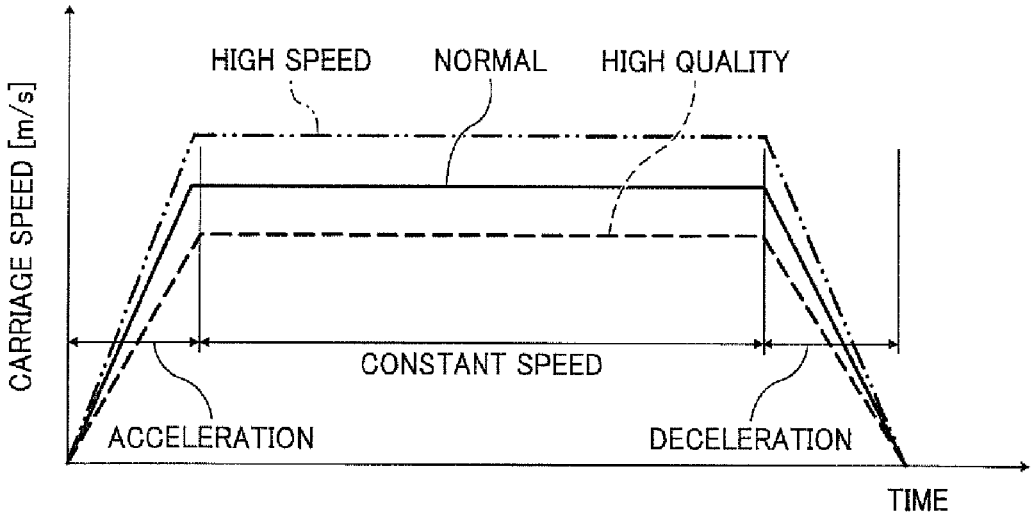
FIG. 15 is a schematic diagram illustrating an example of a speed profile of the carriage.

In accordance with the speed profile of the carriage 15 stored in a speed profile storage 64 as shown in FIG. 15, for example, and an output of the linear encoder 20 that detects the position of the carriage 15 in the main scan direction, the main scan controller 63 calculates a difference between the present speed and the target speed, and obtains an amount of control (i.e., PI control value). Then, the main scan controller 63 controls the main scan motor 16 through a motor driver 65 and moves the carriage 15 in the main scan direction at a predetermined speed.

Based on information on the print mode provided by an information processor of the host side or the operation panel 6 and information on the recording medium 30 (sheet information), the main scan controller 63 selects a certain speed profile among the plurality of the speed profiles stored in the speed profile storage 64 and uses the selected speed profile.

The print mode includes, for example, a normal mode, a high speed mode, and a high quality mode. In the normal mode, an image quality and a carriage speed are preset, and an image is formed in accordance with the preset image quality and the carriage speed. In the high speed mode, the image quality is not as good as the normal mode, but the print speed is fast. In a high quality mode, the print speed is slower than the normal mode, but the image quality is superior.

The types of the recording medium include, for example, a normal paper, a gloss paper, a paper for ink jet printing, and so forth. The speed profile storage 64 stores a plurality of speed profiles corresponding to each print mode. In accordance with the selected print mode and the corresponding speed profile, the main scan controller 63 drives the main scan motor 16.

A scanner controller 70 drives the scanner 2 (the image reader) to read an image.

A sub-tank ink detector 71 shown in FIG. 14 detects an amount of ink remaining in the sub-tank 27 shown in FIG. 3. An amount of ink initially supplied to the sub-tank 27 is set as an initial value, for example. The amount of ink remaining in the sub-tank 27 is detected based on the amount of consumed ink and an amount of supplied ink to the sub-tank 27 during the print operation. The consumed ink is obtained by adding the number of ink droplets and an amount of the ink ejected from the recording head 25, and an amount of ink ejected from the recording head 25 during the recovery operation of the recording head 25.

A temperature detector 72 shown in FIG. 14 detects the temperature in the vicinity of the carriage 15 or inside the image forming apparatus 1.

A damping controller 80 receives information on the selected speed profile from the main scan controller 63, information on whether or not the scanner 2 is reading an image from the scanner controller 70, information on the amount of remaining ink in the sub-tank from the sub-tank ink detector 71, the temperature information from the temperature detector 72, the encoder output from the linear encoder 20, and the motor input value from the main scan controller 63.

The motor input value provided to the motor driver 65 by the main scan controller 63 is a PWM value (signal) because the main scan motor 16 is driven through PWM control.

When the carriage 15 is moved in the main scan direction by the main scan controller 63, the damping controller 80 drives a drive member driver 82 that drives the drive member 106 of the damping mechanism 101 through a driver 81. The positional energy of the counter weight 102 is stored before the damping timing. At the damping timing, the vibration suppression operation, hereinafter simply referred to as the damping operation, is performed. In the damping operation, the positional energy is released.

For the sake of simplicity, the drive member driver 82 that drives the drive member 106 of the damping mechanism 101 is shown separately from the drive source that drives other components. However, as described above, the common drive source for other components can be used for the drive member 106.

Subsequently, the controller 80 changes the shock absorbing characteristics (characteristic value) of the shock absorber 103 by the pressure member 111 through the driver 83. In this case, the characteristic value of the shock absorber 103 is changed in accordance with the mass (weight) of the carriage 15. The mass (weight) of the carriage 15 is obtained by detecting (calculating) the actual mass (weight) of the carriage 15 based on, for example, a result provided by the sub-tank ink detector 71. In other words, generally, the inertial force F of the carriage 15 can be obtained by multiplying a mass m by acceleration a ($m \times a$). However, when equipped with the sub ink tank 27, the actual mass of the carriage 15 varies as the ink is consumed, thereby changing the inertial force as well.

In view of this, the characteristic value of the shock absorber 103 is changed in accordance with the actual mass of the carriage 15 so that the change in the acceleration of the counter weight 102 when the counter weight 102 slows down and the change in the acceleration of the carriage 15 when the carriage slows down correspond each other. Accordingly, more accurate damping can be performed.

In addition, based on the temperature detected by the temperature detector 72, the damping controller 80 changes the characteristic value of the shock absorber 103. Because a load and a viscous resistance value of the ink tube 29 connected to the carriage 15 and a viscous resistance value of the guide rod 13 change due to the temperature, the characteristic value of the shock absorber 103 is changed so that the change in the acceleration of the counter weight 102 when the speed of the counter weight slows down and the change in the acceleration of the carriage 15 correspond each other, thereby enabling accurate damping operation.

The damping controller 80 changes the shock absorbing characteristics or the characteristic value of the shock absorber 103 based on the motor input value. That is, the actual moving state (acceleration) of the carriage 15 and the PWM value are detected to change the characteristic value of the shock absorber 103. This also enables the accurate damping operation.

Figure 16:
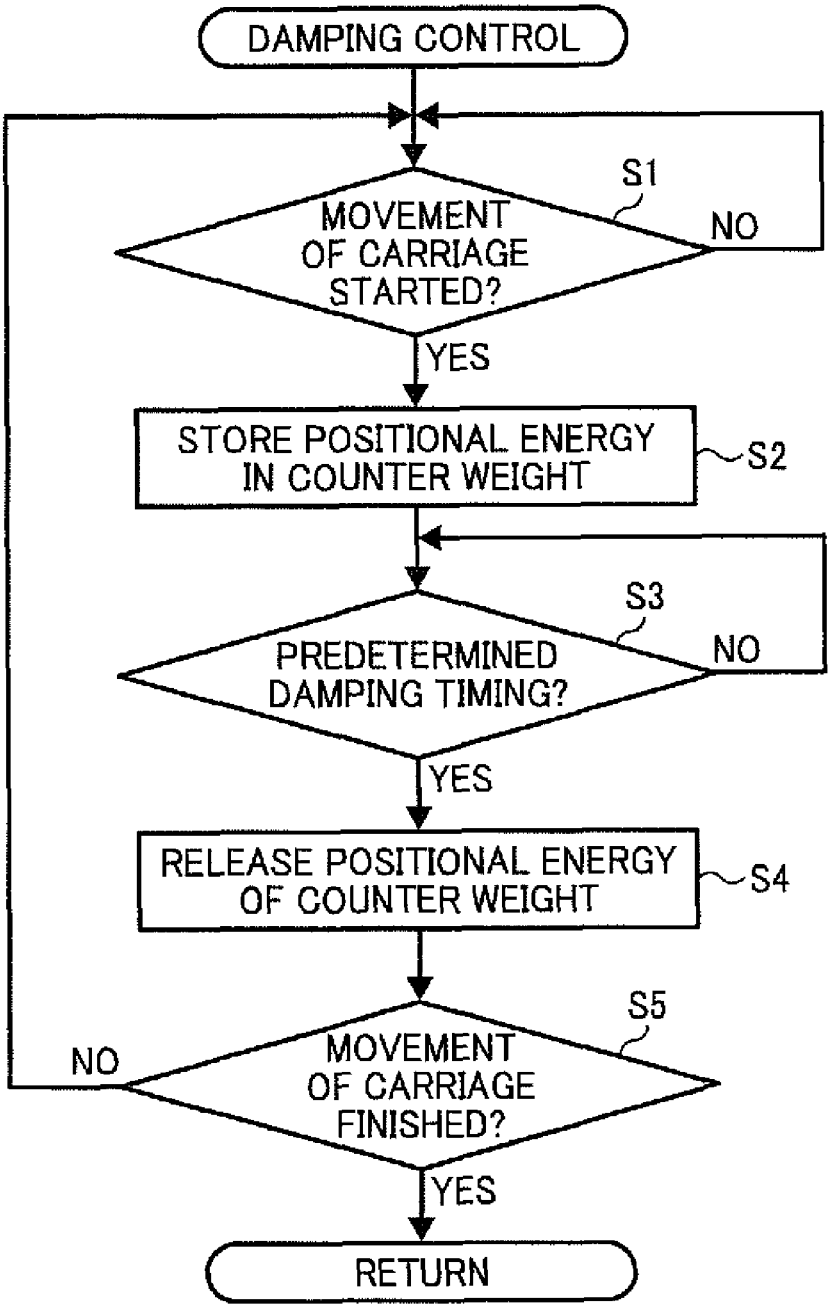
FIG. 16 is a flow chart showing an example procedure of damping control by the control unit of FIG. 14.

Referring now to FIG. 16, there is provided a flow chart showing an exemplary procedure of control of damping.

When the carriage 15 starts to move (YES at S1), the damping controller 80 drives the drive member driver 82 at a predetermined timing to enable the counter weight 102 of the damping mechanism 101 to store its positional energy at S2. When the speed of the carriage 15 is in the deceleration range and it is determined that the predetermined damping timing has come at S3, the positional energy of the counter weight 102 is released at S4. Consequently, as described above, the counter weight 102 strikes the shock absorber 103, thereby suppressing vibration caused by the inertial force of the carriage 15.

According to the present embodiment, when the carriage slows down, damping is performed. Alternatively, damping can be performed when the speed of carriage is increased.

As described above, the damping mechanism 101 performs damping when the carriage 15 is either accelerated or decelerated, and damping is not performed when the carriage 15 moves at a constant speed. Accordingly, when forming an image, while the carriage moves at the constant speed, vibration that adversely affects ejection of ink from the recording head 25 can be suppressed, if not prevented entirely. In particular, misalignment of ejection of ink due to vibration is prevented, thereby preventing degradation of imaging quality.

Figure 17:
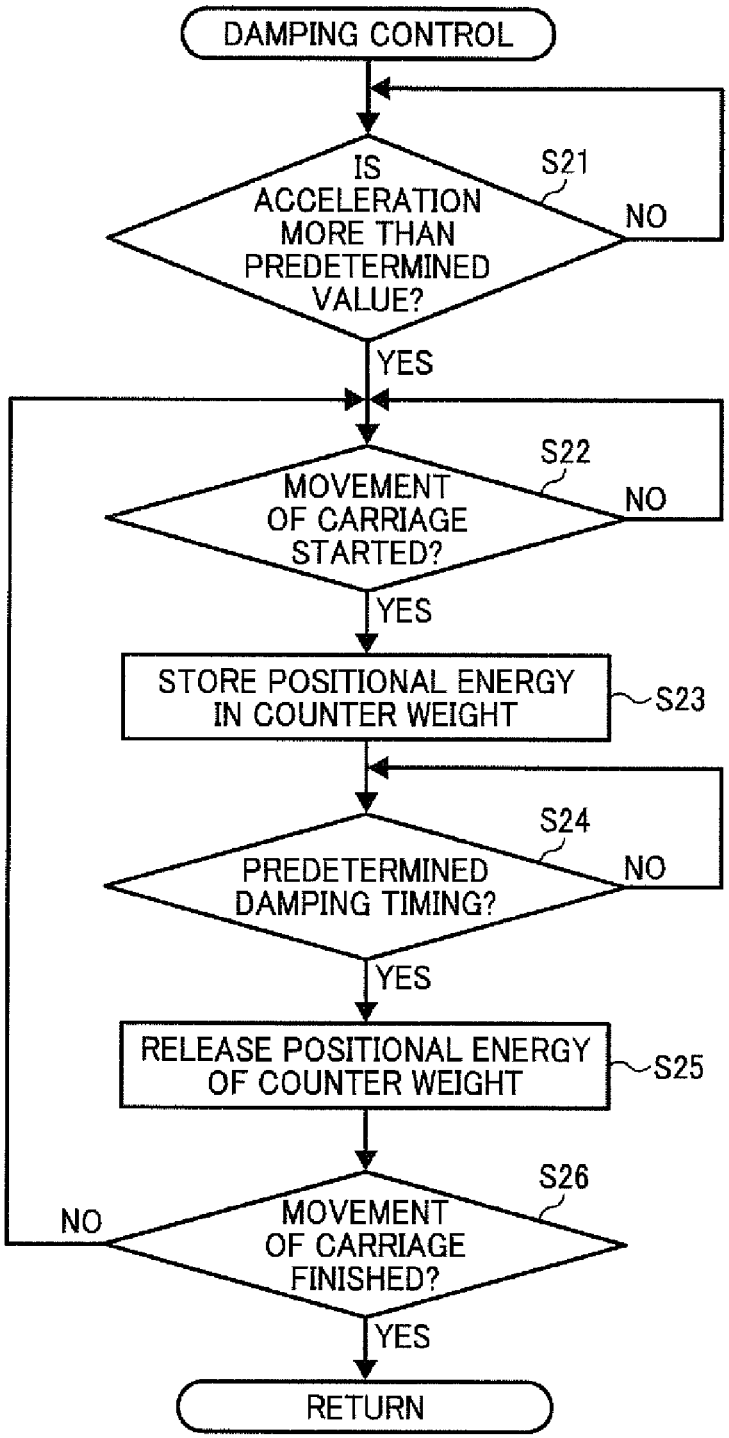
FIG. 17 is a flow chart showing another example procedure of damping control by the control unit of FIG. 14.

Referring now to FIG. 17, there is provided a flow chart showing another exemplary procedure of control of damping.

In FIG. 17, whether or not the speed of the carriage is equal to or greater than the predetermined acceleration speed is determined based on the appropriate (selected) speed profile at S21. If the speed of the carriage is equal to or greater than the predetermined acceleration speed (YES at S21), damping is performed as described above. By contrast, if the speed of the carriage is not equal to or greater than the predetermined acceleration speed, damping is not performed (NO at S21).

For example, when the selected speed profile is the high quality mode as described above, damping is not performed. When, on the other hand, the selected speed profile is the normal mode or the high speed mode, the damping mechanism 101 is configured to perform damping.

According to the present embodiment, damping is performed when the acceleration of the carriage is equal to or greater than the predetermined value. Alternatively, damping can be performed only when the scanner 2 reads an image. Accordingly, damping can be performed efficiently. That is, damping is performed only when image reading or forming is adversely affected.

Figure 18:
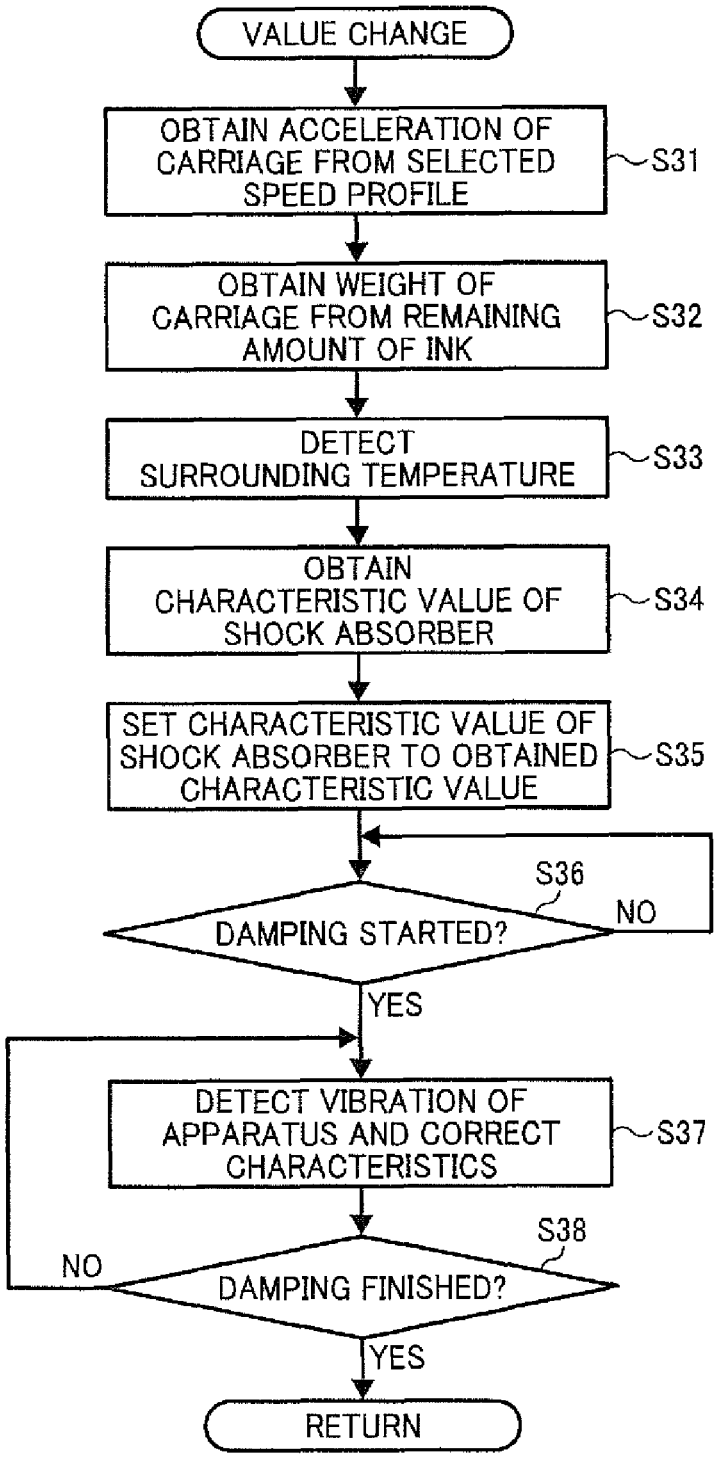
FIG. 18 is a flow chart showing an example of an adjustment of characteristics of a suppressing member according to the illustrative embodiment of the present invention.

Referring now to FIG. 18, there is provided a flow chart showing an exemplary procedure of adjustment of the characteristic value of the shock absorber 103 by the damping controller 80.

The speed of the carriage 15 in the acceleration region and the deceleration region is calculated based on the speed profile selected in accordance with the print mode and the type of the recording medium at S31. Subsequently, the amount of remaining ink detected by the sub-tank ink detector 71 is calculated at S32, and the temperature detector 72 detects the surrounding temperature at S33. The detected temperature is incorporated. Based on the amount of remaining ink and the temperature, the characteristic value or a correction value of the shock absorber 103 of the damping mechanism 101 is calculated at S34. In accordance with the calculated characteristic value or the correction value of the shock absorber 103, the pressure member 111 is driven to adjust the characteristic value of the shock absorber 103 to the calculated characteristic value at S35.

It is to be noted that calculation or adjustment of the characteristic value includes obtaining a certain value using a look up table.

The inertial force of the carriage 15 is obtained by the actual mass of the carriage 15 obtained from the amount of the remaining ink multiplied by the acceleration of the carriage obtained from the speed profile (F=Mass m×Acceleration a). The characteristic value of the shock absorber 103 is set so as to generate an impact that cancels out the inertial force.

As described above, when the temperature around the carriage 15 is detected, the load and the viscous resistance value of the ink tube 29 connected to the carriage 15 and the viscous resistance value of the guide rods 13 and 14 that support the carriage 15 can be obtained. Using these values, the characteristic value of the shock absorber 103 is adjusted, thereby enabling accurate damping.

Subsequently, when damping is started, the load of moving the carriage 15 (and the actual acceleration of the carriage) is detected from the encoder pulse (the output value of the main scan motor 16) from the encoder 20 and the PWM value (input value to the main scan motor 16) from the main scan controller 63. Based on the detection result, the characteristic vale of the shock absorber 103 is adjusted. Accordingly, more accurate damping can be performed.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:
a housing;
a carriage including an image forming mechanism, to move back and forth in a main scan direction; and
a damping mechanism including a suppression member and a mass member that strikes the suppression member,
wherein the damping mechanism moves the mass member separated from the suppression member such that the mass member contacts the suppression member to generate an impact to suppress vibration caused by movement of the carriage.

2. The image forming apparatus according to claim 1, wherein the damping mechanism is disposed on the housing.

3. The image forming apparatus according to claim 1, wherein the damping mechanism is disposed substantially above the carriage.

4. The image forming apparatus according to claim 1, wherein the damping mechanism suppresses vibration during at least one of acceleration and deceleration of the carriage, and is inactive during movement of the carriage at a constant speed.

5. The image forming apparatus according to claim 1, wherein the damping mechanism suppresses vibration when acceleration of the carriage equals or exceeds a predetermined threshold acceleration.

6. The image forming apparatus according to claim 1, wherein the suppression member is at least one of a shock absorber and an elastic member.

7. The image forming apparatus according to claim 6, wherein the shock absorber includes at least one of a spring and a damper.

8. The image forming apparatus according to claim 6, wherein the elastic member includes at least one of rubber and sponge.

9. The image forming apparatus according to claim 6, wherein shock absorbing characteristics of the shock absorber or elasticity of the elastic member is variable.

10. The image forming apparatus according to claim 9, wherein the shock absorbing characteristics of the shock absorber or the elasticity of the elastic member is variable in accordance with at least one of a weight of the carriage, an acceleration of the carriage, and a load on the carriage during movement of the carriage.

* * * * *